US010609797B1

(12) United States Patent
Jonsson

(10) Patent No.: US 10,609,797 B1
(45) Date of Patent: Mar. 31, 2020

(54) CONSTANT CURRENT DIMMING OF CONSTANT VOLTAGE LOADS

(71) Applicant: Karl S Jonsson, Rancho Santa Margarita, CA (US)

(72) Inventor: Karl S Jonsson, Rancho Santa Margarita, CA (US)

( * ) Notice: Subject to any disclaimer, the term of this patent is extended or adjusted under 35 U.S.C. 154(b) by 0 days.

(21) Appl. No.: 16/523,805

(22) Filed: Jul. 26, 2019

Related U.S. Application Data

(60) Provisional application No. 62/843,965, filed on May 6, 2019.

(51) Int. Cl.
*H05B 33/08* (2020.01)
*H05B 37/02* (2006.01)
*H05B 45/10* (2020.01)

(52) U.S. Cl.
CPC ..... *H05B 45/10* (2020.01)

(58) Field of Classification Search
CPC ..... H05B 33/08; H05B 33/0806; H05B 33/0812; H05B 33/0842; H05B 33/0845; H05B 37/02; H05B 37/0272; H05B 37/0254; H05B 45/10
See application file for complete search history.

(56) References Cited

U.S. PATENT DOCUMENTS 7,038,399 B2 * 5/2006 Lys ..... H05B 33/0809 315/291
7,233,115 B2 * 6/2007 Lys ..... H02M 1/4225 315/291
8,558,413 B1 10/2013 Lepard
8,975,825 B2 3/2015 Hu
9,101,032 B2 * 8/2015 Kim ..... H05B 33/0887
9,155,171 B1 10/2015 Hughes et al.
9,295,142 B1 3/2016 Leinen et al.
9,338,860 B2 * 5/2016 Radermacher ..... H05B 37/0254
10,314,141 B2 * 6/2019 Harvey ..... H05B 33/0854
2015/0195883 A1 * 7/2015 Harris ..... H05B 33/0845 315/155
2017/0238392 A1 * 8/2017 Shearer ..... H05B 33/0854 315/153
2018/0129257 A1 5/2018 Stewart
2018/0139823 A1 5/2018 Hick et al.

OTHER PUBLICATIONS

Wikipedia, Power Over Ethernet, May 23, 2019, Retrieved from https://en.wikipedia.org/w/index.php?title=Power_over_Ethernet&diff=898449968&oldid=894957528 on Aug. 22, 2019.

* cited by examiner

*Primary Examiner* — Thai Pham
(74) *Attorney, Agent, or Firm* — Young's Patent Services; Bruce A. Young

(57) ABSTRACT

An LED load is specified to be driven at a first voltage level for maximum brightness. A driver for the LED load determines a first current level consumed by the LED load while the first voltage level is applied to the LED load. Information is received to set a brightness level of the LED load and a second current level is calculated based on the first current level and the information received. Electrical power is then provided to the LED load at the second current level. A second voltage level of the electrical power provided to the LED with the second current level is unregulated and is less than the first voltage level.

20 Claims, 5 Drawing Sheets

CONSTANT CURRENT DIMMING OF CONSTANT VOLTAGE LOADS

CROSS-REFERENCE TO RELATED APPLICATIONS

This application claims the benefit of U.S. Provisional Application 62/843,965 filed May 6, 2019. This patent is also related to U.S. patent application Ser. No. 16/455,975 filed on Jun. 28, 2019 and U.S. provisional application 62/843,949 filed May 6, 2019, all three of which are hereby incorporated by reference in their entirety herein for any and all purposes.

BACKGROUND

Technical Field

The present subject matter relates to lighting, and more specifically, to control of lighting by a remote power source.

Background Art

Circuitry to dim lighting is well known and has been widely used for many years. Traditional light sources, such as incandescent light bulbs, can be dimmed using a phase-cut dimmer. Such dimmers are widely available and are commonly installed in a lighting circuit in place of a traditional on/off switch. Phase-cut dimmers are typically triac-based and come in various topologies and designs, but they work by cutting off a portion of the alternating-current (AC) waveform to reduce the energy delivered to the light bulb. This worked every well for incandescent bulbs which effectively integrate the AC waveform and have a slow response time which eliminates any flickering. Lighting based on light-emitting diodes (LEDs), however need to include special circuitry to detect the intended dimming level of a traditional phase-cut dimmer to be able of function properly. Some LED drivers are designed to detect the amount of phase-cut on the AC line and then control the brightness of the LEDs using a variable current or a pulse-width modulated signal.

Other techniques for controlling the brightness level of LED-based lighting are also known. Some systems use an analog control signal to communicate a brightness level to an LED driver, such as a signal that varies from 0 volts (V) to turn the lighting off, to 10 V to turn set the lighting to full brightness. Another technique uses a digital addressable lighting interface (DALI) which is a two-way communication system with defined commands for LED drivers. This allows a controller to communicate with individual LED drivers and set the desired brightness level.

Regardless of how the dimming level is controlled, using a phase-cut dimmer on the AC power or using an analog signal or digital messages to the LED driver, there are two basic ways to control the brightness of an LED itself. In one approach, referred to as constant voltage (CV) dimming, an LED load is designed to receive specific DC voltage and a CV-based LED driver will provide whatever current will flow through the LED or LED array being driven. The other approach to drive an LED load is the constant current (CC) method, where the LED driver has a fixed current and will let the voltage level rise of fall dependent upon the LED load.

Brightness of the LED can be controlled by modulating the power delivered by the driver to the LED load. Because LEDs have a non-linear response to voltage, analog modulation of the voltage for dimming is not commonly used with a CV driver. To dim an LED load with a CV driver, the voltage is commonly modulated using pulse width modulation (PWM) or pulse density modulation (PDM), both of affect the percentage of a given time period that the voltage is applied to the LED load which digitally modulates the power delivered. The time period is typically chosen to be short enough that most people can't detect any flickering, such as 16 milliseconds (ms) or less, with the PWM or PDM modulation being performed for each time period. So for example if a 25% brightness is desired, a PWM system may repeatedly turn the voltage on for 4 ms and then turn off the voltage for 12 ms before turning the voltage back on again and repeating.

While a CC driver can use PWM or PDM to modulate the current delivered to the LED load, it is common for a CC driver to dim the LED load by changing the DC current level delivered to the LED load, which is an analog modulation of the power delivered. This technique for dimming an LED has an advantage over PWM and PDM in that it eliminates high frequency flicker from the LED's that can cause health issues such as migraines.

Traditionally, LED drivers receive the incoming power from an AC mains line or in rare cases from a direct current (DC) source. One emerging trend for DC distribution for information technology (IT) equipment, telephones, cameras, and more recently, lighting, is power over Ethernet (PoE). PoE comes in several flavors that mainly are differentiated by power capacity. The Institute of Electrical and Electronics Engineering (IEEE) standard 802.3af was the first PoE standard to be adopted. It specified a way to provide Ethernet data and power up to 15.4 watts (W) through a single cable which was ideal for telephones. IEEE 802.3at come later with capacity up to 30 W and most recently IEEE 802.3bt allows up to 100 W to be provided at voltages up to 57 V. There are also proprietary flavors of PoE such as Cisco Systems' UPoE, Linear Technology's LTPoE, and Microsemi's PowerDsine solution. Devices that source PoE power are known as power sourcing equipment (PSE) and a device that consumes PoE power is known as a powered device (PD).

BRIEF DESCRIPTION OF THE DRAWINGS

The accompanying drawings, which are incorporated in and constitute part of the specification, illustrate various embodiments. Together with the general description, the drawings serve to explain various principles. In the drawings.

DETAILED DESCRIPTION

Figure 1:
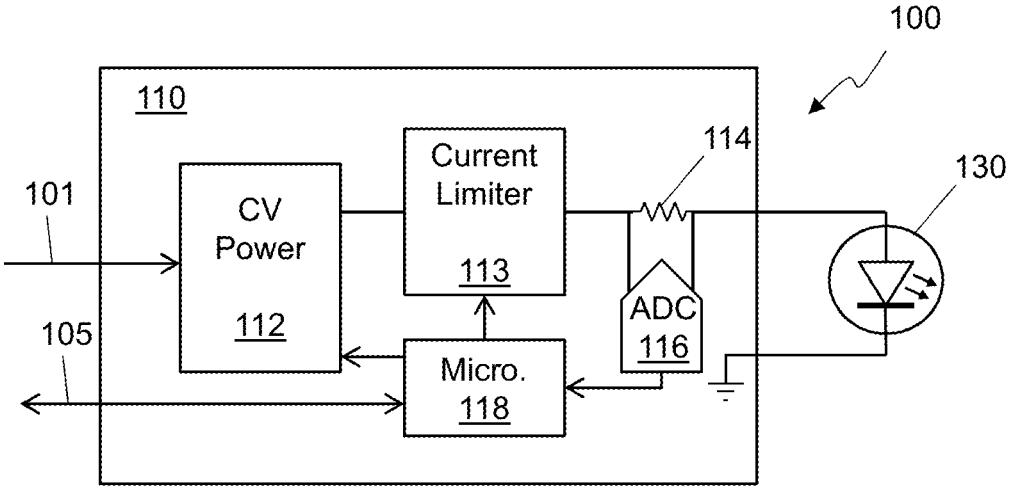
FIG. 1 shows a block diagram of an embodiment of a system providing constant current (CC) drive for a constant voltage (CV) load.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures and components have been described at a relatively high-level, without detail, in order to avoid unnecessarily obscuring aspects of the present concepts. A number of descriptive terms and phrases are used in describing the various embodiments of this disclosure. These descriptive terms and phrases are used to convey a generally agreed upon meaning to those skilled in the art unless a different definition is given in this specification.

Various types of LED loads may be configured to be driven by either a constant voltage (CV) driver or a constant current (CC) driver. Some LED loads may have both voltage level and current level specified so that either type of driver can be used. Some LED loads, such as LED strips or LED flextape may be configured in the field so that while one drive parameter (e.g. voltage for a LED strip specified for a CV driver) may stay the same as the configuration of the LED load changes, the other parameter (e.g. current for a CV load) may change. As a non-limiting example, an LED lighting strip may be designed to be driven at 24 VDC and may be available at a variety of lengths up to 25 feet (ft), consuming 3.8 watts (W) per ft. Furthermore, the example LED lighting strip may be configured in the field to a shorter length at 2.4 inch (in) increments. Thus, the amount of current consumed by the example LED lighting strip driven at 24 VDC may vary from almost 4 amperes (A) for a 25 ft long strip consuming 95 W, to only 0.031 A for a 2.4 in long strip consuming less than 1 W, with a 10 ft long strip consuming 38 W which is 1.58 A at 24 VDC. So while a CV driver or power supply can be sold that will work with the strip cut to any length as long as it regulates the voltage to 24 VDC and can supply up to 95 W of power, a different CC driver or power supply would be needed for each different length. Different LED strips are sold for different voltage level drivers. Some use 24 VDC as in the example above, but LED strips may commonly use 5 VDC, 12 VDC, or 48 VDC and strips for other voltages may also be available. Voltage regulated power supplies or CV LED drivers to drive those loads are also commonly available for those same voltages.

Note that as the terms are used here, constant current (CC) drive means that current is regulated and the voltage may vary as necessary to meet the desired current level. This may also be referred to as a current-regulated power supply. Constant voltage (CV) drive means that the voltage is regulated and the current is allowed to vary as necessary to keep the voltage at the desired level, which may also be referred to as a voltage-regulated power supply. A constant current drive may have its current level changed and a constant voltage drive may have its voltage level changed or rapidly switched on and off using pulse-width modulation (PWM) to provide dimming of the LED load.

Some CV drivers support dimming, although some do not. The dimming may be controlled by a 0-10V control signal, commands received over a network, infrared (IR) or radio-frequency (RF) commands from a remote control, or any other method. As was mentioned earlier, because LEDs exhibit highly non-linear behavior with respect to voltage, a CV driver uses PWM or PDM to vary the brightness of the LEDs. This may cause flickering or electromagnetic interference (EMI). Analog modulation of the current is generally thought to be a better solution for dimming LEDs, but this is not possible if the maximum current draw of the LED load is not known, which is the case for variable length LED strips as one non-limiting example.

Embodiments are disclosed here that allow analog modulation of the current for a CV load to provide smooth, flicker-free, low EMI, controlled dimming of CV loads such as variable length LED strips. Embodiments may automatically determine a maximum current for an attached LED load, and then perform analog modulation of that current to dim the LED load. The modulation may be linear in some embodiments, but other embodiments may use a current versus (vs) brightness curve (e.g. an equation or table lookup) or input from a sensor to determine how to modulate the current for a particular brightness level.

In some embodiments, a driver may be marketed for a particular voltage of CV LED load. Thus a first driver may be designed to support a 24 VDC CV load and a second driver may be designed to support a 12 VDC CV load. Some drivers may support a variety of CV loads set by a one or more switches, a particular value of resistor, a command received from a network or remote control before the load is powered, or any other mechanism. Other drivers may automatically determine a voltage for the CV load. In some embodiments, a driver may utilize a separate power supply that is selected to match the CV load and be able to operate over a range of voltages, such as 10 VDC to 30 VDC which would allow the driver to support both 12 VDC and 24 VDC CV loads when paired with a matching power supply.

In some embodiments, current metering may be provided at the output of the driver. The current metering may be included in an integrated circuit that is used to regulate the power output, a current-sensing coil or shunt resistor may be provided on the power output that can be monitored to determine the current flowing to the load. The driver may determine a maximum current ($I_{max}$) by providing the specified CV voltage to the load and measuring the current flowing to the load to determine the current flowing at maximum brightness of the load. This determination of $I_{max}$ may be performed at any time, including, but not limited to, soon after power if first provided to the driver, in response to a command from a network or remote control, in response to actuation of a physical switch on the driver, or periodically. Once $I_{max}$ has been determined, the driver can use that value to determine an amount of current to provide for a desired brightness level as a percentage of the maximum brightness, acting as a CC driver for the CV load. Embodiments may include voltage limiting circuitry to avoid damaging the load if the load changes after $I_{max}$ has been determined.

If the load needs to be changed after an initial installation, such as cutting the LED strip or adding additional LED strip in series with the previously installed LED strip, an installer or electrician simply simply power off the driver, add or remove length to the CV LED load and power up the driver again. In embodiments, the driver may perform a new measurement to determine $I_{max}$ after power cycle as discussed above.

In some embodiments, a driver may always act as a CC driver. In such embodiments, the driver may measure the output voltage as it ramps up the current provided to the load until the output voltage is equal to the specified CV drive level. Once the output voltage is equal to the CV drive level, the current can be measured to determine $I_{max}$. In some embodiments, the voltage may be measured near the load instead of at the driver. This may be useful in embodiments where there is a significant length of wire between the driver and the load. Taking the concept further, embodiments may include an intermediate device between the driver and the load, which may be located close to the load, which can monitor the voltage level and communicate with the driver to indicate that the proper CV voltage has been reached. This intermediate device may be referred to as a load identification device (LID). The LID could be set for a particular CV voltage to match the load, and a driver could be a universal driver able to support a LID for any CV voltage and power level within a maximum voltage and power capability of the driver.

As a non-limiting example, a CC driver could support universal voltage and drive current and reside away from the load as a stand-alone driver device. Such a universal driver (UD) may be a centralized driver capable of powering multiple loads and may utilize Ethernet cables with PoE to connect to LIDS. The UD could by default output a minimal voltage enough to power a remote LID, and once powered, the LID may indicate to the UD information about the load, such as whether the load is a CC or CV load and what voltage level or current level is requested by the load. The information may be provided to the UD over one or more wires of the cable coupling the LID to the UD. Some embodiments may be compatible with the disclosure of U.S. provisional application 62/843,949 entitled Remote Dimming of Lighting, with the UD being power sourcing equipment (PSE) and the LID being a powered device (PD). Other embodiments of a LID may be passive and may use different resistance values between a designated pair of wires to indicate a particular CV or CC drive level.

If the LID indicates that the load is a CC load, the UD can adjust its settings to the max current indicated by the LID. If the LID indicates that the load is a CV load, the UD could start increasing its current output until the LID indicates the target voltage is achieved. As an example, the target voltage may be 24V but 26V may be provided by the UD in order to achieve 24V at the LID due to voltage drop in the cables. Once an indication that the target CV voltage has been met at the load is received, the UD can set its maximum current to the current measured at that time. As a safety feature, some embodiments of a LID may include an over-voltage protection to ensure that the CV voltage level of the load is not exceeded.

Some embodiments may include a light sensor to determine brightness from the LED load. The light sensor may be coupled to the LID or the driver itself and used to determine how much power to provide to the load. Power limits of the LED load would be observed, however, to make sure the desired light level isn't beyond what the light/luminaire can deliver.

Reference now is made in detail to the examples illustrated in the accompanying drawings and discussed below.

FIG. 1 shows a block diagram of an embodiment of a system 100 providing constant current (CC) drive for a constant voltage (CV) load 130. The system includes a driver 110 and a CV load 130. In embodiments, the driver 110 may be selected to match the CV voltage of the load 130 or the driver may be configured at a time of installation to match the CV voltage of the load 130, manually, automatically, or programmatically, depending on the embodiment. The driver 110 receives power from power source 101 which can be any type of power source, but may be an alternating current AC source connected to a power grid (e.g. 110 VAC power), a battery, a photovoltaic cell, or any other power source. The load 130 may include one or more light-emitting diodes (LEDs) which may be arranged in any topology including, but not limited to, multiple LEDs coupled in series (i.e. a string of LEDs), multiple LEDs coupled in parallel, and multiple strings of LEDs coupled in parallel. In some embodiments, the load 130 may be a commercially available LED strip which can be cut at predetermined points to a variable length. In embodiments, the load 130 may be designed to be driven at a particular voltage (i.e. a CV load). The CV voltage can be any predetermined voltage, depending on the embodiment, but may be 5 VDC, 12 VDC, 24 VDC, or 48 VDC as non-limiting examples. In the case of the LED strip, the CV voltage for a particular strip may remain constant even for different lengths of the strip.

The driver 110 may include a voltage-regulated power supply 112, which may also be referred to as a constant voltage (CV) supply. The power supply 112 may be able to provide a particular voltage level for any current load up to the maximum specified load for that embodiment. So for example, a 60 W, 12 VDC power supply 112 may be able to provide a steady 12 VDC at any current level up to 5 A.

The driver 110 may also include a processor 118, such as a microcontroller with integrated memory containing a program to control the driver 110. In some embodiments, the processor 118 may be coupled to a control interface 105 to provide input to the processor 118. The control interface 105 can be any communication path that allows the processor 118 to receive information about how to control the load 130, and may be coupled to a user interface, such as a knob, slider, keyboard, touchscreen, or buttons, or may be coupled to a remote control which communicates over an infrared (IR) or radio-frequency (RF) signal. In some embodiments, the control interface 105 may be a computer network, such as an internet protocol (IP) over Ethernet or Wi-Fi. Alternatively, the control interface 105 may be a home automation network such as Z-Wave or Zigbee or may be a personal area network such as Bluetooth.

The processor 118 may control a current limiting device 113 which can receive a voltage-regulated power input and provide a current-regulated output. In some embodiments, the CV power supply 112 and the current limiter 113 may be integrated into a single module that can act as either a voltage-regulated power source or a current-regulated power source, under control of the processor 118. The current flowing from the current limiter 113 may be measured by using a shunt resistor 114 to carry the power from the current limiter 113 to the load 130 and measuring the voltage across the shunt resistor 114 using the analog-to-digital converter (ADC) to provide the measurement to the processor 118. Other embodiments may use other techniques to measure the current including, but not limited to, a current transformer, a Hall effect sensor, a magneto-resistive sensor, a fiber optic current sensor, instrumentation in the voltage-regulated power supply 112, instrumentation in the current limiter 113, a dedicated energy measurement chip such as a CS5463 from Cirrus Logic, or a dedicated energy measurement module integrated into the processor 118 such as the ESP430 module in a MSP 430 from Texas Instruments.

Figure 2:
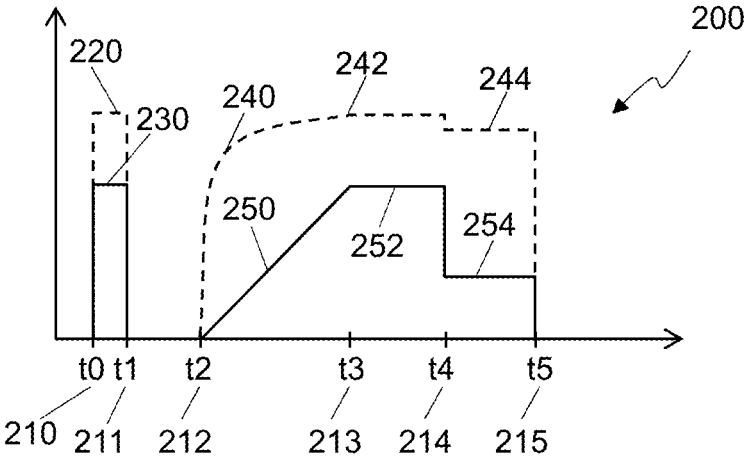
FIG. 2 shows voltage and current waveforms for the embodiment of FIG. 1.

FIG. 2 shows voltage and current waveforms 200 for the system 100 providing constant current (CC) drive for a constant voltage (CV) load 130. Voltage waveforms 220, 240, 242, 244 are shown in broken lines and current waveforms 230, 250, 252, 254 are shown in solid lines. Voltage/current levels are qualitatively indicated along the vertical axis and time advances toward the right on the horizontal axis. At some point, the driver 110 may determine a maximum current ($I_{max}$) for the load 130. This may occur upon application of power to the driver 110, as a part of a boot-up process (or reset process) for the processor 118, in response to a manual input to the driver 110, or at any other time, dependent on the embodiment. In the example shown, the driver 110 begins to determine $I_{max}$ at time t0 210 by turning on the CV power supply 112 to provide the full CV voltage 220 and not limiting the current with the current limiter 113 to allow current 230 to flow through the load 130.

The current 230 also flows through the shunt resistor 114 which allows the processor 118 to measure a voltage across the shunt resistor 114 which is proportional to the current 230. The processor 118 may determine the current level based on a calibration of the voltages across the shunt resistor 114 so that the processor 118 can determine a current limiter 113 setting to match the current level 230 based on an equation or a table stored in the memory of the processor 118. But in some embodiments, the processor 118 may vary the settings of the current limiter 113 until the voltage across the shunt resistor 114 begins to drop to determine the setting of the current limiter 113 that matches the current level 230. The setting for the current limiter 113 the matches the current level 230 may become the setting for $I_{max}$. After $I_{max}$ has been determined at time t1 211, the processor 118 may, in some embodiments, turn off the CV power supply 112 or set the current limiter 113 to 0 A to turn off the load 130, but in other embodiments, the CV power supply 112 may be left on at time t1 211 and the current limiter 113 set to a predetermined level which may be any level between 100% and 0% of $I_{max}$, inclusive.

At time t2 212 the driver may receive a command through the control interface 105 to start a slow ramp from 0% to 100% brightness. In some embodiments this may be done using a single command, but other embodiments may send multiple commands, such as 100 commands, each a predetermined time apart (dependent upon the desired ramp speed) indicating a brightness level 1% higher than the previous command. This turn-on ramp is created by the processor controlling the current limiter 113 to generate the current ramp 250 between time t2 212 and time t3 213. As the current linearly ramps up, note that the voltage 240 increases non-linearly due to the physics of LEDs. Once $I_{max}$ 252 is reached at time t3 213, the voltage 242 has reached the full CV voltage.

At time t4 214 the driver 110 may receive a command to set the brightness to 40% over the control interface 105 and respond by setting the current to 40% of $I_{max}$ using the current limiter 113. Depending on the embodiment, the processor 118 may be able to determine the settings for the current limiter 113 corresponding to the 40% of $I_{max}$ current level algorithmically or using a table, but in other embodiments, a control loop using the voltage across the shunt resistor 114 as the feedback may be implemented in the processor 118 to control the current limiter 113. As a result of limiting the current 254 through the load 130 to 40%, the voltage 244 may drop below the CV voltage, but is still much more than 40% of the CV voltage due to the non-linear response of the LED 130 to current.

At time t5 215 the driver 110 may receive a command over the control interface 105 to turn off the LED 130 and the processor 118 may respond by shutting off the CV power supply 112 or telling the current limiter 113 to set the current to 0 A. As additional commands may be received and processed by the driver 110, the current to the load 130 may vary to any level between 0 A and $I_{max}$ but the voltage level is not allowed to exceed the CV voltage for the load 130 because that is the maximum voltage provided by the CV power supply 112, although some embodiments may include voltage protection circuitry to protect against voltage spikes that may be caused by inductance of cables carrying the current to the load 130.

Figure 3:
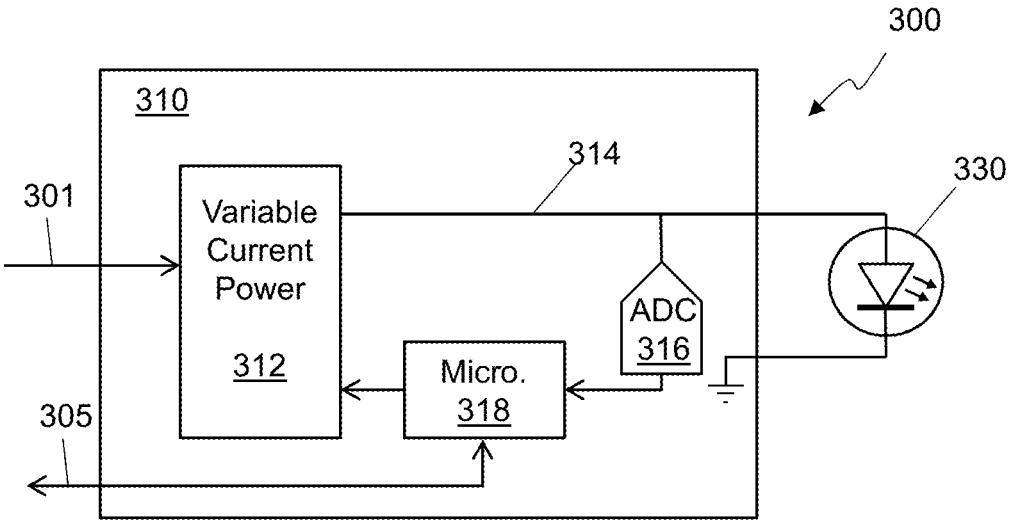
FIG. 3 shows a block diagram of an alternative embodiment of a system providing CC drive for a CV load.

FIG. 3 shows a block diagram of an alternative embodiment of a system 300 providing CC drive for a CV load 330. The system includes a driver 310 and a CV load 330. In embodiments, the driver 310 may be selected to match the CV voltage of the load 330 or the driver may be configured at a time of installation to match the CV voltage of the load 330, manually, automatically, or programmatically, depending on the embodiment. In some embodiments, the driver 310 may include an RFID tag holding information about what type of load to drive from the driver 310 (e.g. CV or CC and/or a voltage or current level) where the RFID tag was programmed using an RFID writer at the factory or in the field using a smartphone. The driver 310 receives power from power source 301 which can be any type of power source, but may be an alternating current AC source connected to a power grid (e.g. 110 VAC power), a battery, a photovoltaic cell, or any other power source. The load 330 may include one or more light-emitting diodes (LEDs) which may be arranged in any topology including, but not limited to, multiple LEDs coupled in series (i.e. a string of LEDs), multiple LEDs coupled in parallel, and multiple strings of LEDs coupled in parallel. In some embodiments, the load 330 may be a commercially available LED strip which can be cut at predetermined points to a variable length. In embodiments, the load 330 may be designed to be driven at a particular voltage (i.e. a CV load). The CV voltage can be any predetermined voltage, depending on the embodiment, but may be 5 VDC, 12 VDC, 24 VDC, or 48 VDC as non-limiting examples. In the case of the LED strip, the CV voltage for a particular strip may remain constant even for different lengths of the strip.

The driver 310 may include a current-regulated power supply 312, which may also be referred to as a constant current (CC) supply even though the current level may be varied under control of the processor 318. The power supply 312 may be able to provide a specified current level at any voltage up to the CV voltage of the load and up to a maximum specified power for that embodiment. So for example, a 60 W, 5 A max power supply 312 may be able to provide a specified current of up to 5 A at up to the 12 VDC for a 12 VDC CV load 330.

The driver 310 may also include a processor 318, such as a microcontroller with integrated memory containing a program to control the driver 310. In some embodiments, the processor 318 may be coupled to a control interface 305 to provide input to the processor 318. The control interface 305 can be any communication path that allows the processor 318 to receive information about how to control the load 330, and may be coupled to a manual input, such as a knob, slider, keyboard, touchscreen, or buttons, or may be coupled to a remote control which communicates over an infrared (IR) or radio-frequency (RF) signal. In some embodiments, the control interface 305 may be a computer network, such as an internet protocol (IP) over Ethernet or Wi-Fi. Alternatively, the control interface 305 may be a home automation network such as Z-Wave or Zigbee or may be a personal area network such as Bluetooth in some embodiments.

As indicated earlier the processor 318 may control the current-regulated power supply 312. The current flowing from the power supply 312 may be determined directly from the control of the power supply 312, such as a digital interface where a particular current level is provided to the power supply 312 by the processor 318, or may be measured by using any method and used in a feedback control loop to control the current flowing from the power supply 312. An ADC 316 may be used to measure the voltage of the output 314 of the power supply 312 and provide the measurement to the processor 318, although in other embodiments, instrumentation in the power supply 312 may be able to provide information about the present voltage level of its output to the processor 318.

Figure 4:
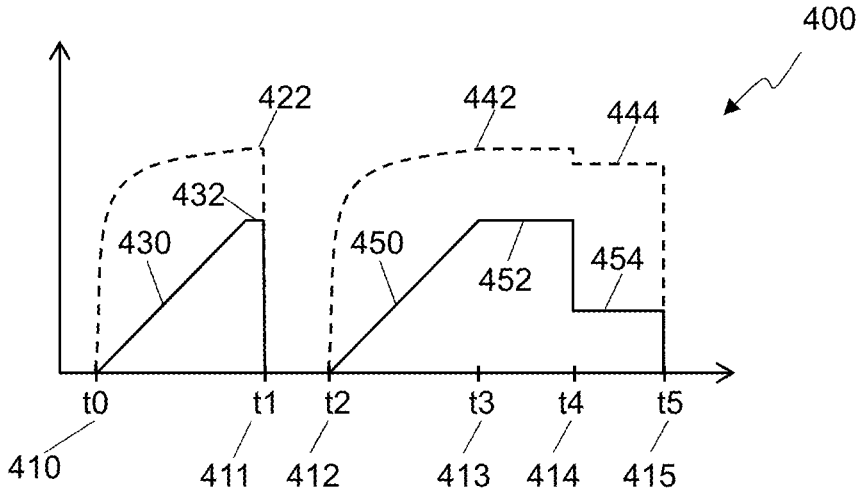
FIG. 4 shows voltage and current waveforms for the embodiment of FIG. 3.

FIG. 4 shows voltage and current waveforms 400 for the system 300 providing constant current (CC) drive for a constant voltage (CV) load 330. Voltage waveforms 422, 442, 444 are shown in broken lines and current waveforms 430, 432, 452-454 are shown in solid lines. Voltage/current levels are qualitatively indicated along the vertical axis and time advances toward the right on the horizontal axis. At some point, the driver 310 may determine a maximum current ($I_{max}$) for the load 330. This may occur upon application of power to the driver 310, as a part of a boot-up process (or reset process) for the processor 318, in response to a manual input to the driver 310, or at any other time, dependent on the embodiment. In the example shown, the driver 310 begins to determine $I_{max}$ at time t0 410 by gradually ramping up the current 430 provided by the power supply 312 until the CV voltage 422 is reached. At that time, the current 432 provided by the power supply 312 is determined to be $I_{max}$. After $I_{max}$ has been determined at time t1 411, the processor 318 may, in some embodiments, turn off the power supply 312 to turn off the load 130, but in other embodiments, the power supply 312 may be set to a predetermined level at time t1 411 which may be any level between 100% and 0% of $I_{max}$, inclusive.

At time t2 412 the driver may receive a command through the control interface 305 to start a slow ramp from 0% to 100% brightness. This turn-on ramp is created by the processor 318 controlling the power supply 312 to generate the current ramp 450 between time t2 412 and time t3 413. Once $I_{max}$ 452 is reached at time t3 413, note that the voltage 442 has reached the full CV voltage.

At time t4 414 the driver 310 may receive a command to set the brightness to 40% over the control interface 305 and respond by setting the current of the power supply 312 to 40% of $I_{max}$ which causes the voltage 444 to drop somewhat below the CV voltage. At time t5 415 the driver 310 may receive a command over the control interface 305 to turn off the LED 330 and the processor 318 may respond by shutting off the power supply 312. As additional commands may be received and processed by the driver 310, the current to the load 330 may vary to any level between 0 A and $I_{max}$ but the voltage level is not allowed to exceed the CV voltage for the load 130. Some embodiments may include a separate voltage limiting circuit as a safety measure.

Figure 5:
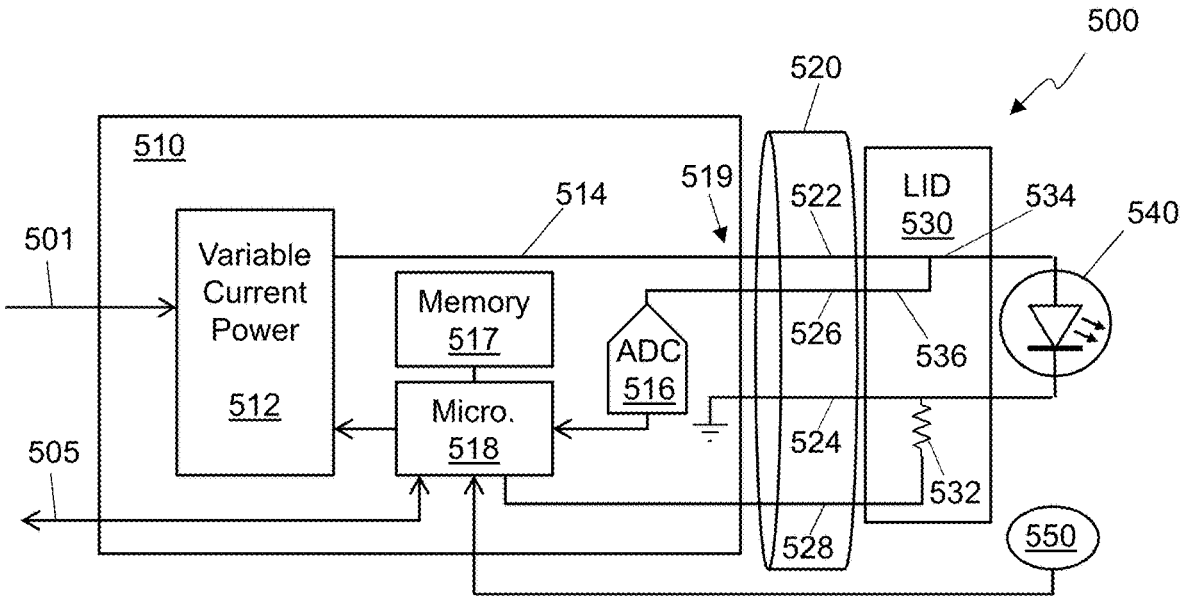
FIG. 5 shows a block diagram of an embodiment of a system providing CC drive for a CV load using a load identification device (LID)

FIG. 5 shows a block diagram of an embodiment of a system 500 providing CC drive for a CV load using a load identification device (LID) 330. The system includes a driver 510 and a CV load 540 with a LID 530 positioned between them. A cable 520 couples the LID 530 to the driver 510 in the embodiment shown. The cable 520 may be any type of cable, depending on the embodiment, but may be a cable 520 with four twisted pair conductors in some embodiments, such as a category 3, category 5, category 5e, category 6, or category 7 cable which is commonly used for Ethernet networking. The cable 520 may couple to the driver 510 and the LID 530 using any electrical connection mechanism, including any type of connector, but in some embodiments, an RJ-45 connector with 8 contacts may be used on both ends of the cable 520.

The LID 530 includes an interface to the cable 520, which may be a female RJ-45 connector in some embodiments, an interface to the LED device(s) 540, which may be an LED strip connector in some embodiments, a power conductor 534 connecting a power connection of the cable interface to a power connection of the LED interface, and circuitry 532 coupled to the cable interface, to provide drive information about the LED device 540 through the cable 520. In various embodiments, the circuitry may include one or more switches or resistors coupled between connections of the cable interface, such as the resistor 532 shown. In other embodiments, the circuitry may include a memory device, such as (but not limited to) a flash memory with a serial interface or a radio-frequency identification (RFID) tag, storing the drive information and coupled to at least one connection of the cable interface. The circuitry may also include a sense conductor 536 connected to the power conductor 534 and to a sense connection 526 of the cable interface. The circuitry may include a current sensor coupled to a sense connection 524 of the cable interface configured to sense a current flowing through the power conductor 534 in some embodiments.

The LED driver 510 includes a drive interface for an LED load 519 and a current regulator 512 coupled between a source of electrical power 501 and the drive interface 519. In some embodiments. The source of electrical power 501 may be a connection to an AC power source, such as a wall outlet or wired connection to electrical wiring of a building, and the current regulator 512 may be a current-regulated DC power supply. In other embodiments, the source of electrical power may be a voltage-regulated DC power supply and the current regulator may provide a current limiting function on that DC power supply's output. The LED drive 510 also includes a control interface 505 and a processor 518 coupled to the current regulator 513 and the control interface 505, as well as a non-transitory storage medium 517 (e.g. a semiconductor memory) storing one or more instructions that in response to being executed by the processor 518 cause the LED driver to perform one or more methods described herein. The memory may be embedded in the processor 518 or may be a separate component, depending on the embodiment.

In embodiments, the driver 510 may determine a CV voltage level or a CC current level for the load 540 based on its connection to the LID 530 and the driver 510 may be able to function with a variety loads having different CV voltages or CC currents. The LID 530 may signal characteristics of the load 540 using any technique, including, but not limited to, using different values of resistance for a resistor 532 between a pair of conductors on the cable 520, providing different sets of pull-up or pull-down resistors on wires of the cable 520, different connections between wires of the cable 520 using switches, jumpers, or traces on a printed circuit board, providing an analog voltage on one or more wires of the cable 520, sending a digital message using any serial or parallel communication protocol using one or more of the wires of the cable 520, any other communication techniques, or any combination thereof. In some embodiments, the LID 530 may provide the information about the load 540 before the driver 510 provides any power to the LID 530. In other embodiments, the driver 510 may provide low-voltage power, lower than is normally used to power an LED load, such as power at a voltage lower than 5 V, to power circuitry on the LID 530 which then sends the information to the driver 510. In other embodiments, circuitry on the LID 530 may work in conjunction with the driver 510 to help the driver 510 determine the information.

In the embodiment shown, the LID 530 includes a resistor 532 selected to convey information about the load 540. The resistor 532 may be loaded at the factory and the LID 530 marketed to work with one specific type of load 540 (e.g. a 24 VDC CV load), but in other embodiments, the resistance 532 may be field configurable using jumpers, selection of one of a set of resistors to load into a socket, or using switches on the LID 530 to select one of several resistors. The processor 518 may be able to determine the value of resistor 532 by applying a voltage and measuring a current through the resistor 532, or by providing a set current and measuring the voltage created across the resistor 532. Any method can be used to measure the resistance. Table 1 below provides one non-limiting example of how resistor values may be used to indicate information about the load 540.

TABLE 1

| Type of Load | Drive Level | Resistance Value |
|---|---|---|
| CV | 5 VDC | 100 kΩ |
| CV | 12 VDC | 124 kΩ |
| CV | 24 VDC | 154 kΩ |
| CV | 48 VDC | 196 kΩ |
| CC | 350 mA | 243 kΩ |
| CC | 700 mA | 309 kΩ |
| CC | 1000 mA | 383 kΩ |

The driver 510 receives power from power source 501 which can be any type of power source, but may be an alternating current (AC) source connected to a power grid (e.g. 110 VAC power), a battery, a photovoltaic cell, or any other power source. The load 540 may include one or more light-emitting diodes (LEDs) which may be arranged in any topology including, but not limited to, multiple LEDs coupled in series (i.e. a string of LEDs), multiple LEDs coupled in parallel, and multiple strings of LEDs coupled in parallel. In some embodiments, the load 540 may be a commercially available LED strip which can be cut at predetermined points to a variable length.

The driver 510 may include a current-regulated power supply 512, which may also be referred to as a constant current (CC) supply even though the current level may be varied under control of the processor 518. Other embodiments of a driver configured to work with a LID 530 may utilize a CV supply with a current limiter similar to the driver 110 shown in FIG. 1. The power supply 512 may be able to provide a specified current level at any voltage up to a CV voltage of the load and up to a maximum specified power for that embodiment. So for example, a 60 W, 5 A max power supply 512 may be able to provide a specified current of up to 5 A at up to the 12 VDC for a 12 VDC CV load 540. In some embodiments, the driver 510 may be able to drive a load 540 that is a CC load up to the maximum current capability of the power supply 512.

The driver 510 may also include a processor 518, such as a microcontroller with integrated memory containing a program to control the driver 510. In some embodiments, the processor 518 may be coupled to a control interface 505 to provide input to the processor 518. The control interface 505 can be any communication path that allows the processor 518 to receive information about how to control the load 540, and may be include to a user interface, such as a knob, slider, keyboard, touchscreen, or buttons, or may be coupled to a remote control which communicates over an infrared (IR) or radio-frequency (RF) signal. The user interface or the remote control may be used to receive a user input to provide to the processor 518. In some embodiments, the control interface 505 may be a computer network, such as an internet protocol (IP) over Ethernet or Wi-Fi. Alternatively, the control interface 505 may be a home automation network such as Z-Wave or Zigbee or may be a personal area network such as Bluetooth in some embodiments.

As indicated earlier the processor 518 may control the current-regulated power supply 512. The current flowing from the power supply 512 may be determined directly from the control of the power supply 512, such as a digital interface where a particular current level is provided to the power supply 512 by the processor 518, or may be measured by using any method and used in a feedback control loop to control the current flowing from the power supply 512. Similarly to the processor 310 of FIG. 3 as shown by the waveforms 400 of FIG. 4, the processor 518 may ramp an amount of current provided to the load 540 until the CV voltage level is met for a CV load 540 to determine $I_{max}$. An ADC 516 may be used to measure the voltage of the power conductor 534 in the LID 530 (or at the load 540) and provide the measurement to the processor 518. This may be accomplished by connecting a sense wire 526 on the cable 520 to the power rail at the LID 530 and using the ADC 516 to measure the voltage at the sense wire. This allows the driver 510 to compensate for voltage losses in the cable 520. In other embodiments, the LID 530 may include voltage measurement circuitry and send a digital indication of the voltage level to the driver 510. In other embodiments, the LID 530 may not signal its CV voltage to the driver 510, but use on-board circuitry to compare the drive voltage to its CV voltage and send a binary signal across the cable 520 to the processor 518 once the voltage level matches the specified CV drive level. Depending on the length of the cable 520, the gauge of the wires 522, 524 carrying power in the cable 520, and the number of wires used in the cable 520 to carry power, non-negligible power may be consumed by the cable 520 itself resulting in a voltage crop across the cable 520. So for example, if the load 540 is a 24 VDC load consuming 60 W, 5 A of current is flowing through the cable 520 and if the resistance of the power conductors of the cable is 0.5Ω, the voltage drop across the cable 520 would be 2.5 V. Thus the voltage of the power 514 in the driver may be 2.5 V higher than the voltage of the power conductor 534 at the load 540, so it may be helpful to measure the voltage at the load 540 instead of at the driver 510.

Similarly to the driver 310 of FIG. 3, the driver 510 may respond to commands received over the control interface 505 by controlling the amount of current provided by the power supply 512 to the load 540 to control its brightness. The value of $I_{max}$ may be used in conjunction with the desired brightness level received in the command to determine how much current to provide to the load 540. In some embodiments, the driver 510 may be coupled to a light sensor 550 to measure the brightness of the load 540. Information collected from the brightness sensor may be used to provide more accurate control of the brightness of the load 540.

Figure 6:
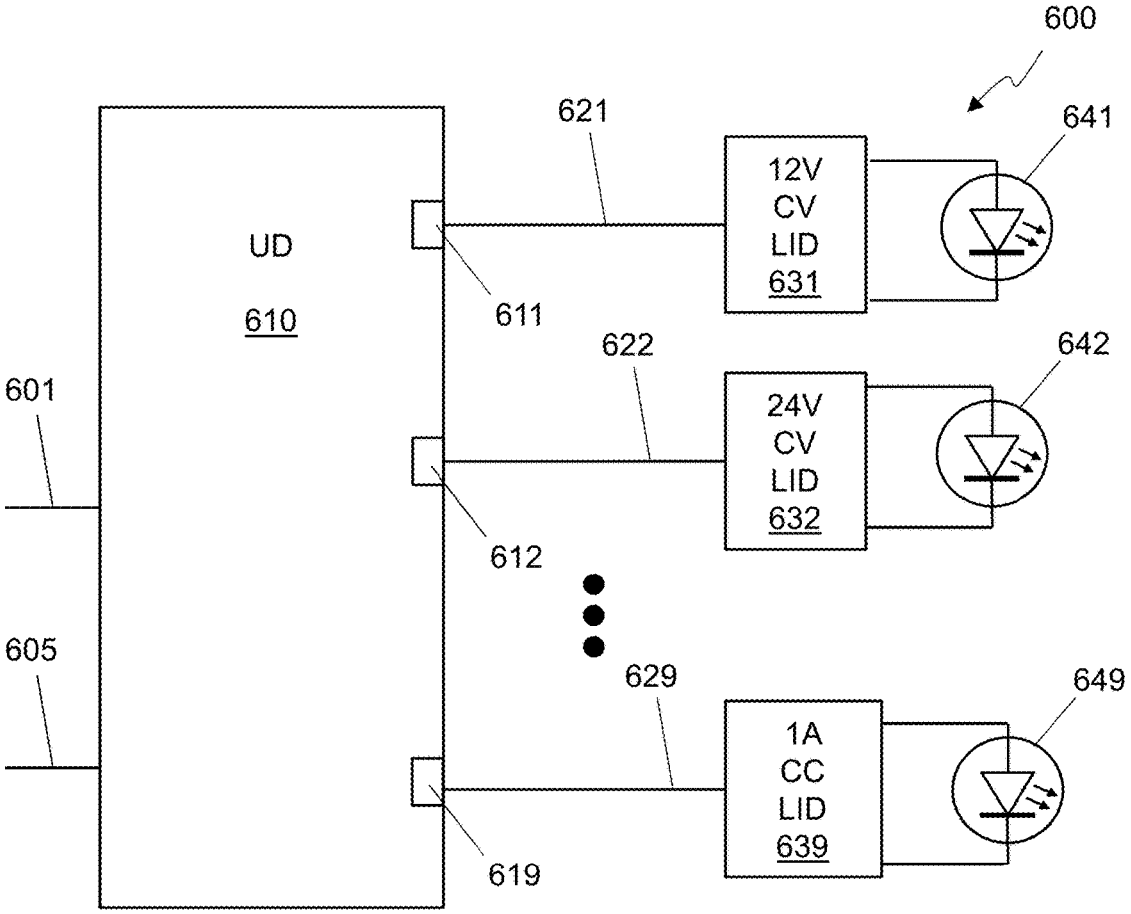
FIG. 6 shows a block diagram of an embodiment of a system providing CC drive for a CV load using centralized power source.

FIG. 6 shows a block diagram of an embodiment of a system 600 providing CC drive for a CV load 641, 642 using centralized power source 610. The system 600 may also include CC loads 649 driven from the same power source 610. The power source 610 may be referred to as a universal driver (UD) and may also be compliant with IEEE power-over-ethernet (PoE) standards in some embodiments as power sourcing equipment (PSE). The UD 610 is coupled to a power source 601, which may be any type of power source, including, but not limited to, 110 VAC power from a standard electrical outlet. The UD 610 is also coupled to a computer network 605, such as, but not limited to, an Ethernet network of any type or a Wi-Fi network. The UD 610 may have any number of connectors 611-619 capable of driving an LED load. In some embodiments, one or more of the connectors 611-619 may also be an Ethernet port and may support network equipment compliant with IEEE PoE standards.

In embodiments, cables 621-629 may be used to couple LIDs 631-639 to connectors 611-619 of the UD 610. The cables 621-629 may be compliant with IEEE PoE standards in some embodiments. A LID 631-539 may include circuitry to communicate information about an LED load 641-649 to the UD 610. Various embodiments may use different types of circuitry, including, but not limited to different resistors, a non-volatile memory on the LID 631-639 that can be read by the UD 610 over a cable 621-629 or read by a circuitry on the LID 631-639 and sent to the UD 610. In at least one embodiment, the LID includes an RFID tag holding the information where the RFID tag was programmed using an RFID writer at the factory or in the field using a smartphone.

In the example shown, the first LID 631 is configured to support an LED load 641 that is a CV 12 VDC load, the second LID 632 is configured to support an LED load 642 that is a CV 24 VDC load, and the third LID 639 is configured to support an LED load 649 that is a CC 1 A load. Once the UD 610 receives the information from the LIDs 631-639, it knows the maximum current of the third LED load 649 is 1 A but it does not know the maximum current of the other two LED loads 641, 642. The UD 610 may utilize techniques described herein to determine maximum currents for the first LED load 641 and the second LED load 642.

Once the information about the LED loads 641-649 has been determined, the UD 610 may expose the existence of the LED loads 641-649 as individual devices on the network 605. In some embodiments, the UD 601 may group two or more of the LED loads 641-649 as a single device exposed on the network. An IP address may be allocated for each individual LED load 641-649, an aggregate of LED loads 641-649, or as functions within the UD 610 which may have its own IP address. Any discovery protocol may be used to expose the LED loads 641-649 and its capabilities to other devices on the network, including, but not limited to, IP-based discovery protocols such as universal plug-and-play (UPnP), simple service discovery protocol (SSDP—which uses UPnP protocols), multicast domain name service (mDNS), or AllJoyn (which utilizes mDNS). Any data structure, protocol, or technique can be used to specify the functionality and control parameters of the LED loads 641-649 through the discovery service, including, but not limited to, DotDot from the Zigbee Alliance, lightweight machine-to-machine protocol (LWM2M) from the Open Mobile Alliance (OMA), specifications from the Open Connectivity Foundation (OCF), Mesh Objects, JavaScript Object Notation (JSON) objects, eXtensible Markup Language (XML) objects, other standards, data structures, or mechanisms, or combinations thereof. Once the existence and capabilities of the LED loads 641-649 are exposed on the network, other applications, devices, or entities may control the LED loads 641-649 through the UD 610, but the exact mechanisms used to do that, which may be standards-based or proprietary, are beyond the scope of this disclosure, although examples might include the ability to turn the LED loads 641-649 on or off, set a brightness level of the LED loads 641-649, control a color or color temperature of the LED loads 641-649, or query a status of the LED loads 641-649.

Aspects of various embodiments are described with reference to flowchart illustrations and/or block diagrams of methods, apparatus, systems, and computer program products according to various embodiments disclosed herein. It will be understood that various blocks of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and/or block diagrams in the figures help to illustrate the architecture, functionality, and operation of possible implementations of systems, methods and computer program products of various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Figure 7:
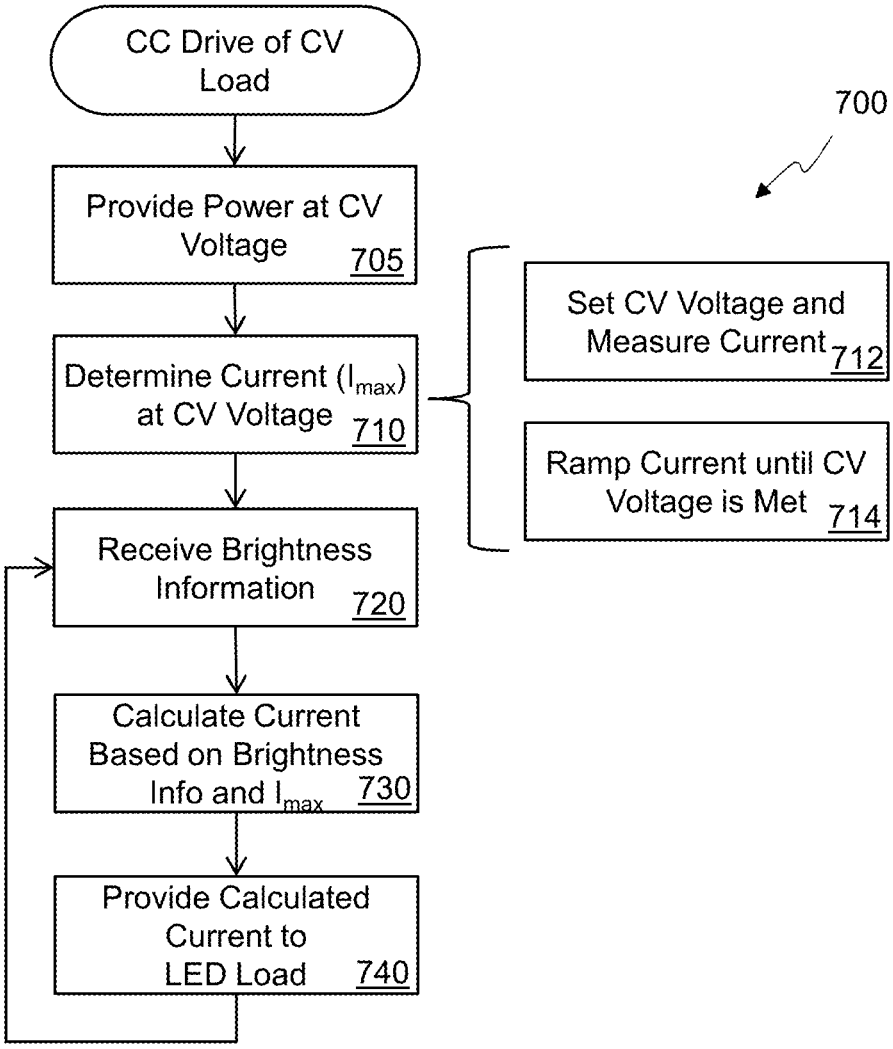
FIG. 7 is a flowchart of an embodiment of a method for providing constant current (CC) drive for a constant voltage (CV) load.

FIG. 7 is a flowchart 700 of an embodiment of a method for providing constant current (CC) drive for a constant voltage (CV) load. The flowchart starts with providing power 705 to the CV load at the specified CV voltage level and determining 710 a current ($I_{max}$) of the load, which may be one or more LED arranged in any topology, when the voltage provided to the load is set to the specified CV voltage level. The maximum current may be determined each time that power is provided to the drive device (i.e. a power-up reset), at regular intervals, in response to a manual input (e.g. a button push), in response to receipt of a calibration command from a computer network or a remote control, upon detection of a change in the CV load, or based on any other stimulus.

The CV voltage level used may be predetermined or may be received as a user input. In some embodiments, information indicating the CV voltage level may be received from the CV load. The information may be received by any technique, including, but not limited to, measuring one or more resistance values of the LED load or using a serial communication protocol. In some embodiments, a load identification device coupled to one or more LEDs may provide the drive information through a cable.

$I_{max}$ may be determined using any technique, but a first embodiment may provide a power signal at the CV voltage from a voltage-regulated power supply and measure 712 the current, which is interpreted as $I_{max}$. The measurement may be performed using instrumentation included in the power supply, by measuring a voltage across a shunt resistor included in the current path to the load, or by using an inductive current sensor coupled to the current path (e.g. a current sensing coil surrounding a conductor carrying the first electrical power to the LED load). A second embodiment may use a current-regulated power supply and measure 714 the voltage across the load. The voltage may be measured at the source, or to be more accurate, at the load, depending on the embodiment. The power source may ramp the current up until the designated CV voltage level is met, and the current at that time is interpreted as $I_{max}$. In some embodiments that include a brightness sensor, a brightness reading may be taken at the time the $I_{max}$ is determined to determine a maximum brightness level.

The driver may receive brightness information 720 indicating a desired brightness of the load. In some embodiments, the brightness may simply be an on/off command or the brightness may be indicated as a percentage of maximum. In other embodiments, the brightness may be indicated as a particular lux level and the driver may be coupled to a brightness sensor. The brightness information may be received from a manual input (e.g. a rotatable knob or a linear slider), an analog voltage signal (e.g. a 0-10 VDC signal), a command received over a digital communications interface (e.g. a computer network), a command received as an infrared (IR) or radio-frequency (RF) signal from a remote control, or by any other technique.

Once the brightness information has been received 720, a current may be calculated 730 based on the desired brightness information and $I_{max}$. In some embodiments, a linear brightness response to current may be assumed, so that if brightness is provided as a percentage of maximum brightness, the brightness percentage is multiplied by $I_{max}$ to calculate the desired current. In other embodiments, a brightness curve, in the form of an equation or a lookup table, may be used to calculate the desired current from the desired brightness. In systems where an absolute brightness is provided, the desired current may be based on $I_{max}$ multiplied by the ratio of desired brightness to maximum brightness.

The calculated current is then provided 740 to the load to turn provide the desired brightness from the LEDs. In some systems, a current limiting device on an output of a voltage-regulated power supply may be used to limit the current, but in other systems, a current-regulated power supply may be used so that a control signal is provided to the power supply to set the current to the desired level. In some systems, feedback from the brightness sensor may be used to fine tune the brightness after the calculated current is provided to the load.

In embodiments, new brightness information may be received 720 at any time. A new current may then be calculated 730 and provided 740 to the load. It should be noted that the load may be 'turned on' by setting the current to $I_{max}$ or 'turned off' by setting the current to 0 A.

Figure 8:
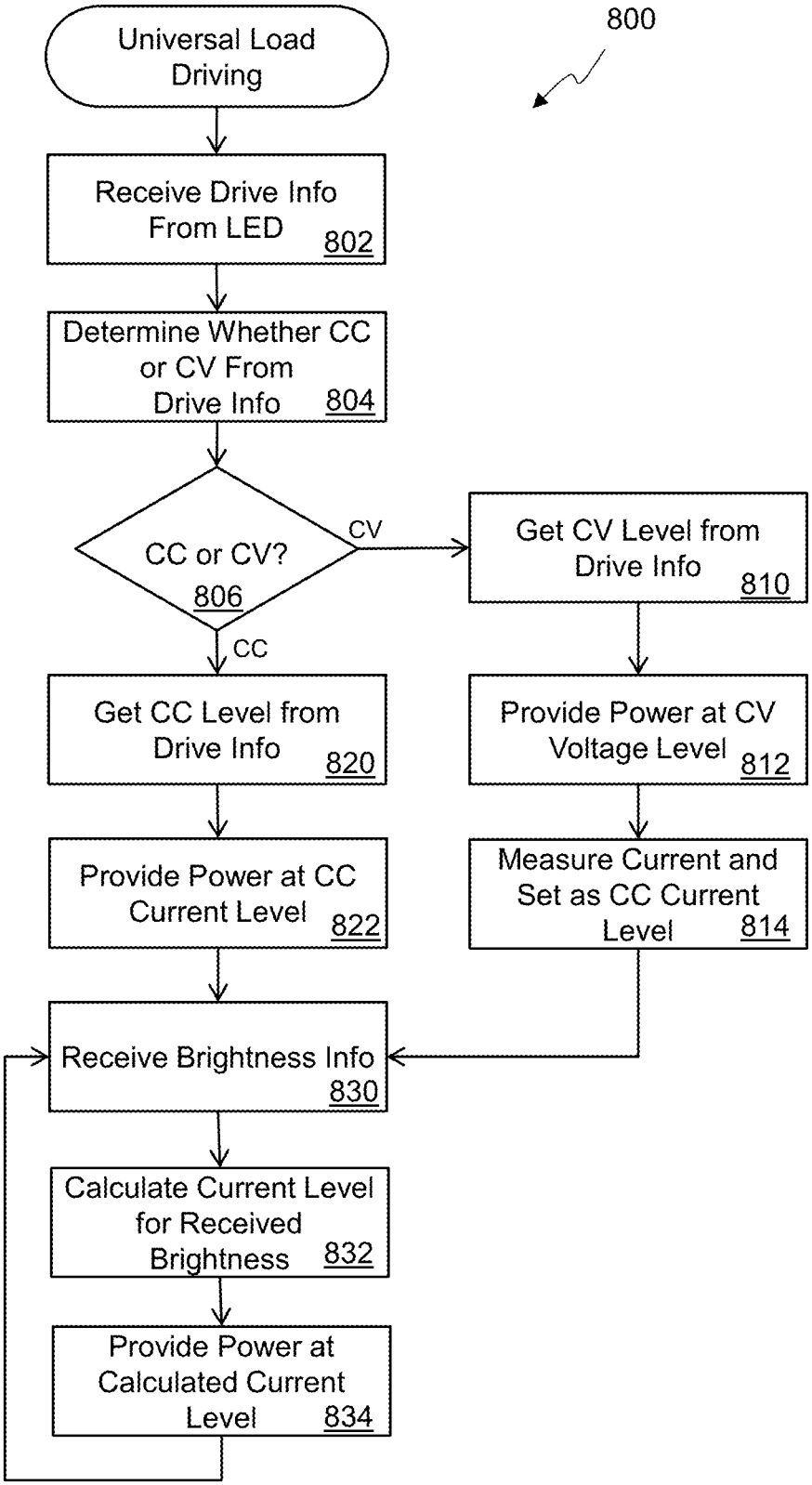
FIG. 8 is a flowchart of an embodiment of a method for universal driving of an LED load.

FIG. 8 is a flowchart 800 of an embodiment of a method for universal driving of an LED load. The method commences with receiving 802 drive information from the LED load. Any technique may be used to receive the drive information from the LED load, some of which are described above. The drive information is examined to determine 804 whether the LED load has a constant voltage (CV) characteristic or a constant current (CC) characteristic. Different action may be taken 806 depending on whether the LED load has a CV characteristic or a CC characteristic.

If the LED load has the CV characteristic, a CV level is determined 810 based on the drive information and electrical power is provided 812 to the LED load at the CV level that is based on the drive information. The power may be set to the CV level by using a voltage regulated power supply, or by ramping up the current until the CV level is equaled if a power supply that can only regulate the current is used. If the LED load has the CC characteristic, a CC level is determined 820 based on the drive information and electrical power is provided 822 to the LED load at the CC level that is based on the drive information.

In some embodiments a current level may be determined 814 (e.g. measured) for the LED load while the CV voltage level is applied to the LED load in response to said determining that the LED load has the CV characteristic and set as a CC level for the CV load. Brightness control information for the LED load may be received 830 and a current level calculated 832 based on the brightness control information and the CC level for the load. Electrical power may then be provided 834 to the LED load regulated to the calculated current level regardless of whether the LED load has the CV characteristic or the CC characteristic. This may be repeated as new brightness control information is received 830.

As will be appreciated by those of ordinary skill in the art, aspects of the various embodiments may be embodied as a system, device, method, or computer program product apparatus. Accordingly, elements of the present disclosure may take the form of an entirely hardware embodiment, an entirely software embodiment (including firmware, resident software, micro-code, or the like) or an embodiment combining software and hardware aspects that may all generally be referred to herein as a "server," "circuit," "module," "client," "computer," "logic," or "system," or other terms. Furthermore, aspects of the various embodiments may take the form of a computer program product embodied in one or more computer-readable medium(s) having computer program code stored thereon.

Any combination of one or more computer-readable storage medium(s) may be utilized. A computer-readable storage medium may be embodied as, for example, an electronic, magnetic, optical, electromagnetic, infrared, or semiconductor system, apparatus, or device, or other like storage devices known to those of ordinary skill in the art, or any suitable combination of computer-readable storage mediums described herein. In the context of this document, a computer-readable storage medium may be any tangible medium that can contain, or store a program and/or data for use by or in connection with an instruction execution system, apparatus, or device. Even if the data in the computer-readable storage medium requires action to maintain the storage of data, such as in a traditional semiconductor-based dynamic random access memory, the data storage in a computer-readable storage medium can be considered to be non-transitory. A computer data transmission medium, such as a transmission line, a coaxial cable, a radio-frequency carrier, and the like, may also be able to store data, although any data storage in a data transmission medium can be said to be transitory storage. Nonetheless, a computer-readable storage medium, as the term is used herein, does not include a computer data transmission medium.

Computer program code for carrying out operations for aspects of various embodiments may be written in any combination of one or more programming languages, including object oriented programming languages such as Java, Python, C++, or the like, conventional procedural programming languages, such as the "C" programming language or similar programming languages, or low-level computer languages, such as assembly language or microcode. The computer program code if loaded onto a computer, or other programmable apparatus, produces a computer implemented method. The instructions which execute on the computer or other programmable apparatus may provide the mechanism for implementing some or all of the functions/acts specified in the flowchart and/or block diagram block or blocks. In accordance with various implementations, the program code may execute entirely on the user's computer, partly on the user's computer, as a stand-alone software package, partly on the user's computer and partly on a remote computer or entirely on the remote computer or server, such as a cloud-based server. In the latter scenario, the remote computer may be connected to the user's computer through any type of network, including a local area network (LAN) or a wide area network (WAN), or the connection may be made to an external computer (for example, through the Internet using an Internet Service Provider). The computer program code stored in/on (i.e. embodied therewith) the non-transitory computer-readable medium produces an article of manufacture.

The computer program code, if executed by a processor causes physical changes in the electronic devices of the processor which change the physical flow of electrons through the devices. This alters the connections between devices which changes the functionality of the circuit. For example, if two transistors in a processor are wired to perform a multiplexing operation under control of the computer program code, if a first computer instruction is executed, electrons from a first source flow through the first transistor to a destination, but if a different computer instruction is executed, electrons from the first source are blocked from reaching the destination, but electrons from a second source are allowed to flow through the second transistor to the destination. So a processor programmed to perform a task is transformed from what the processor was before being programmed to perform that task, much like a physical plumbing system with different valves can be controlled to change the physical flow of a fluid.

Examples of various embodiments are described in the following paragraphs:

Embodiment 1

A method of driving an LED load, the method comprising: providing electrical power to the LED load at a first voltage level; determining a first current level consumed by the LED load while the first voltage level is applied to the LED load; receiving brightness control information for the LED load; calculating a second current level based on the first current level and the brightness control information; and providing the electrical power to the LED load regulated at the second current level; wherein a second voltage level of the electrical power provided to the LED with the second current level is less than the first voltage level.

Embodiment 2

The method of embodiment 1, wherein said providing and said determining are performed in response to a power-up reset.

Embodiment 3

The method of embodiment 1 or 2, wherein the first voltage level is predetermined.

Embodiment 4

The method of embodiment 1 or 2, further comprising receiving a user input to indicate the first voltage level.

Embodiment 5

The method of embodiment 1 or 2, further comprising receiving drive information from the LED load indicating the first voltage level.

Embodiment 6

The method of embodiment 5, further comprising measuring one or more resistance values of the LED load to receive the drive information.

Embodiment 7

The method of embodiment 5 or 6, further comprising communicated with the LED load using a serial communication protocol to receive the drive information.

Embodiment 8

The method of any of embodiments 5 through 7, the LED load comprising a load identification device coupled to one or more LEDs, the drive information received from the load identification device through a cable.

Embodiment 9

The method of any of embodiments 1 through 8, said determining the first current level comprising measuring the first current level using a shunt resistor in series with the LED load or a current sensing coil surrounding a conductor carrying the first electrical power to the LED load.

Embodiment 10

The method of any of embodiments 1 through 8, the LED load comprising a load identification device coupled to one or more LEDs; the load identification device comprising a current sensor. said measuring the first current level comprising receiving current information from the current sensor through a cable coupled to the load identification device.

Embodiment 11

The method of any of embodiments 1 through 8, said determining the first current level comprising querying a current-regulated power supply that is providing the first electrical power to the LED load.

Embodiment 12

The method of any of embodiments 1 through 8, further comprising:

providing the electrical power to the LED load at a regulated current level using a variable current-regulated power supply; measuring an unregulated voltage level provided to the LED load at the regulated current level; increasing the regulated current level until the unregulated voltage level is equal to the first voltage level; and determining the first current level to be the regulated current level.

Embodiment 13

The method of embodiment 12, said measuring the unregulated voltage level comprising measuring a voltage on the load identification device through a sense wire; wherein a single cable coupled to the load identification device includes both the sense wire and a conductor carrying said provided electrical power.

Embodiment 14

The method of any of embodiments 1 through 13, further comprising: receiving drive information from the LED load; determining whether the LED load has a constant voltage load characteristic or a constant current load characteristic based on the drive information; and providing the electrical power to the LED load at a third current level that is based on the drive information in response to said determining that the LED load has the constant current load characteristic; wherein said providing the electrical power to the LED load at the first voltage level is done in response to said determining that the LED load has the constant voltage load characteristic, the first voltage level set based on the drive information.

Embodiment 15

A method of driving an LED load, the method comprising: receiving drive information from the LED load; determining whether the LED load has a constant voltage characteristic or a constant current characteristic based on the drive information; providing electrical power to the LED load at a first voltage level that is based on the drive information in response to said determining that the LED load has the constant voltage characteristic; and providing the electrical power to the LED load at a second current level that is based on the drive information in response to said determining that the LED load has the constant current characteristic.

Embodiment 16

The method of embodiment 15, further comprising: determining a first current level consumed by the LED load while the first voltage level is applied to the LED load in response to said determining that the LED load has the constant voltage characteristic; receiving brightness control information for the LED load; calculating a third current level based on the brightness control information and either the first current level or the second current level; and providing the electrical power to the LED load regulated to the third current level regardless of whether the LED load has the constant voltage characteristic or the constant current characteristic.

Embodiment 17

At least one non-transitory machine readable medium comprising one or more instructions that in response to being executed on a computing device cause the computing device to carry out a method according to any one of embodiments 1 to 16.

Embodiment 18

A load identification device comprising: a first interface for an LED device; a second interface for a power cable; a power conductor connecting a power connection of the first interface to a power connection of the second interface; and circuitry, coupled to the second interface, configured to provide drive information about the LED device through the power cable.

Embodiment 19

The load identification device of embodiment 18, the circuitry comprising one or more switches or resistors coupled between connections of the second interface.

Embodiment 20

The load identification device of embodiment 18, the circuitry comprising a memory device storing the information and coupled to at least one connection of the second interface.

Embodiment 21

The load identification device of embodiment 20, the memory device comprising a radio-frequency identification (RFID) tag.

Embodiment 22

The load identification device of any of embodiments 18 through 21, the circuitry comprising a sense conductor connected to the power conductor and to a sense connection of the second interface.

Embodiment 23

The load identification device of any of embodiments 18 through 21, the circuitry comprising a current sensor coupled to a sense connection of the second interface, the current sensor configured to sense a current flowing through the power conductor.

Embodiment 24

The load identification device of any of embodiments 18 through 23, the second interface comprising a female RJ-45 connector.

Embodiment 25

The load identification device of any of embodiments 18 through 24, the first interface comprising an LED strip connector.

Embodiment 26

An LED driver comprising: a drive interface for an LED load; a current regulator coupled between a source of electrical power and the drive interface; a control interface; a processor coupled to the current regulator and the control interface; and a memory, coupled to the processor, and storing one or more instructions that in response to being executed by the processor cause the LED driver to: provide electrical power to the drive interface at a first voltage level; determine a first current level flowing through the drive interface while the first voltage level is applied to the LED load; receive brightness control information through the control interface; calculate a second current level based on the first current level and the brightness control information; and provide the electrical power at drive interface regulated at the second current level by the current regulator. wherein a second voltage level of the second electrical power provided to the drive interface with the second current level is less than the first voltage level.

Embodiment 27

The LED driver of embodiment 26, wherein the first voltage level is stored in the memory.

Embodiment 28

The LED driver of embodiment 26 or 27, further comprising a user interface, coupled to the processor and configured to provide an indication of the first voltage level.

Embodiment 29

The LED driver of any of embodiments 26 through 28, the one or more instructions, in response to being executed by the processor, further cause the LED driver to receive drive information through the drive interface indicating the first voltage level.

Embodiment 30

The LED driver of embodiment 29, the one or more instructions, in response to being executed by the processor, further cause the LED driver to measure one or more resistance values between conductors of the drive interface to receive the drive information.

Embodiment 31

The LED driver of embodiment 29, the one or more instructions, in response to being executed by the processor, further cause the LED driver to communicate through the drive interface using a serial communication protocol to receive the drive information.

Embodiment 32

The LED driver of any of embodiments 26 through 31, the one or more instructions, in response to being executed by the processor, further cause the LED driver to measure the first current level using a shunt resistor in or a current sensing coil.

Embodiment 33

The LED driver of any of embodiments 26 through 31, the one or more instructions, in response to being executed by the processor, further cause the LED driver to query the current regulator to determine the first current level.

Embodiment 34

The LED driver of any of embodiments 26 through 31, further comprising an analog-to-digital converter; the one or more instructions, in response to being executed by the processor, further cause the LED driver to: provide the electrical power to the drive interface at a regulated current level; measure an unregulated voltage level of the electrical power at the regulated current level; increase the regulated current level until the unregulated voltage level is equal to the first voltage level; and determine the first current level to be the regulated current level.

Embodiment 35

The LED driver of embodiment 34, wherein the analog-to-digital converter is coupled to a sense connection of the drive interface that is separate from a power connection of the drive interface coupled to the current regulator.

Embodiment 36

The LED driver of any of embodiments 26 through 35, the one or more instructions, in response to being executed by the processor, further cause the LED driver to: receiving drive information from the LED load; determining whether the LED load has a constant voltage load characteristic or a constant current load characteristic based on the drive information; and providing the electrical power to the LED load at a third current level that is based on the drive information in response to said determining that the LED load has the constant current load characteristic; wherein said providing the electrical power to the LED load at the first voltage level is done in response to said determining that the LED load has the constant voltage load characteristic, the first voltage level set based on the drive information.

Embodiment 37

An LED driver comprising: a drive interface for an LED load; a regulator coupled between a source of electrical power and drive interface; a processor coupled to the current regulator and the control interface; and a memory, coupled to the processor, and storing one or more instructions that in response to being executed by the processor cause the LED driver to: receive drive information about the LED load through the drive interface; determine whether the LED load has a constant voltage characteristic or a constant current characteristic based on the drive information; provide electrical power to the drive interface at a first voltage level that is based on the drive information in response to said determining that the LED load has the constant voltage characteristic; and provide the electrical power to the drive interface at a second current level that is based on the drive information in response to said determining that the LED load has the constant current characteristic.

Embodiment 38

The LED driver of embodiment 37, further comprising a control interface; the one or more instructions, in response to being executed by the processor, further cause the LED driver to: determine a first current level flowing through the drive interface while the first voltage level is provided in response to said determining that the LED load has the constant voltage characteristic; receive brightness control information through the control interface; calculate a third current level based on the brightness control information and either the first current level or the second current level; and provide the electrical power to the drive interface regulated to the third current level regardless of whether the LED load has the constant voltage characteristic or the constant current characteristic.

Embodiment 39

An article of manufacture comprising a non-transitory storage medium having instructions stored thereon that, if executed, result in: receiving drive information from the LED load; determining whether the LED load has a constant voltage characteristic or a constant current characteristic based on the drive information; providing electrical power to the LED load at a first voltage level that is based on the drive information in response to said determining that the LED load has the constant voltage characteristic; and providing the electrical power to the LED load at a second current level that is based on the drive information in response to said determining that the LED load has the constant current characteristic.

Embodiment 40

The article of manufacture as in embodiment 5, wherein the instructions, if executed, further result in: determining a first current level consumed by the LED load while the first voltage level is applied to the LED load in response to said determining that the LED load has the constant voltage characteristic; receiving brightness control information for the LED load; calculating a third current level based on the brightness control information and either the first current level or the second current level; and providing the electrical power to the LED load regulated to the third current level regardless of whether the LED load has the constant voltage characteristic or the constant current characteristic.

Unless otherwise indicated, all numbers expressing quantities, properties, measurements, and so forth, used in the specification and claims are to be understood as being modified in all instances by the term "about." The recitation of numerical ranges by endpoints includes all numbers subsumed within that range, including the endpoints (e.g. 1 to 5 includes 1, 2.78, $\pi$, $3.\overline{33}$, 4, and 5).

As used in this specification and the appended claims, the singular forms "a", "an", and "the" include plural referents unless the content clearly dictates otherwise. Furthermore, as used in this specification and the appended claims, the term "or" is generally employed in its sense including "and/or" unless the content clearly dictates otherwise. As used herein, the term "coupled" includes direct and indirect connections. Moreover, where first and second devices are coupled, intervening devices including active devices may be located there between.

The description of the various embodiments provided above is illustrative in nature and is not intended to limit this disclosure, its application, or uses. Thus, different variations beyond those described herein are intended to be within the scope of embodiments. Such variations are not to be regarded as a departure from the intended scope of this disclosure. As such, the breadth and scope of the present disclosure should not be limited by the above-described exemplary embodiments, but should be defined only in accordance with the following claims and equivalents thereof.

What is claimed is:

1. A method of driving an LED load, the method comprising:

providing electrical power to the LED load via a drive interface at a first voltage level;

determining a first current level flowing through the drive interface to the LED load while the first voltage level is applied to the LED load;

receiving brightness control information at a processor through a control interface for controlling the LED load;

calculating a second current level, using the processor, based on the first current level and the brightness control information; and providing the electrical power via the drive interface to the LED load regulated at the second current level;

wherein a second voltage level of the electrical power provided to the LED with the second current level is less than the first voltage level.

2. The method of claim 1, wherein said providing the electrical power to the LED load via the drive interface at the first voltage level and said determining the first current level consumed by the LED load are performed in response to a power-up reset.

3. The method of claim 1, wherein the first voltage level is predetermined.

4. The method of claim 1, further comprising receiving a user input to indicate the first voltage level.

5. The method of claim 1, further comprising receiving drive information from the LED load indicating the first voltage level.

6. The method of claim 5, further comprising measuring one or more resistance values of the LED load to receive the drive information.

7. The method of claim 5, further comprising communicating with the LED load using a serial communication protocol to receive the drive information.

8. The method of claim 5, the LED load comprising a load identification device coupled to one or more LEDs, the drive information received from the load identification device through a cable.

9. The method of claim 1, said determining the first current level comprising measuring the first current level using a shunt resistor in series with the LED load or a current sensing coil surrounding a conductor carrying the first electrical power to the LED load.

10. The method of claim 9, the LED load comprising a load identification device coupled to one or more LEDs; the load identification device comprising a current sensor;

said measuring the first current level comprising receiving current information from the current sensor through a cable coupled to the load identification device.

11. The method of claim 1, said determining the first current level comprising querying a current-regulated power supply that is providing the first electrical power to the LED load.

12. The method of claim 1, further comprising:

providing the electrical power to the LED load at a regulated current level using a variable current-regulated power supply;

measuring an unregulated voltage level provided to the LED load at the regulated current level;

increasing the regulated current level until the unregulated voltage level is equal to the first voltage level; and determining the first current level to be the regulated current level.

13. The method of claim 12, said measuring the unregulated voltage level comprising measuring a voltage on the load identification device through a sense wire;

wherein a single cable coupled to the load identification device includes both the sense wire and a conductor carrying said provided electrical power.

14. The method of claim 1, further comprising:

receiving drive information from the LED load;

determining whether the LED load has a constant voltage load characteristic or a constant current load characteristic based on the drive information; and providing the electrical power to the LED load at a third current level that is based on the drive information in response to said determining that the LED load has the constant current load characteristic;

wherein said providing the electrical power to the LED load at the first voltage level is done in response to said determining that the LED load has the constant voltage load characteristic, the first voltage level set based on the drive information.

15. An LED driver comprising:

a drive interface configured to couple to an LED load and including a power connection;

a current regulator coupled between a source of electrical power and the power connection of the drive interface;

a control interface;

a processor coupled to the current regulator and the control interface; and a memory, coupled to the processor, and storing one or more instructions that in response to being executed by the processor cause the LED driver to:

provide electrical power to the power connection of the drive interface at a first voltage level;

determine a first current level flowing through the power connection of the drive interface while the first voltage level is applied to the LED load;

receive brightness control information through the control interface;

calculate a second current level based on the first current level and the brightness control information; and provide the electrical power at the power connection of the drive interface regulated at the second current level by the current regulator;

wherein a second voltage level provided to the power connection of the drive interface with the second current level is less than the first voltage level.

16. The LED driver of claim 15, further comprising an analog-to-digital converter (ADC) coupled to the processor and configured to measure a voltage at the power connection of the drive interface;

the one or more instructions, in response to being executed by the processor, further cause the LED driver to:

provide the electrical power to the power connection of the drive interface at a regulated current level;

measure an unregulated voltage level of the electrical power provided with the regulated current level at the power connection of the drive interface using the ADC;

increase the regulated current level until the unregulated voltage level is equal to the first voltage level; and determine the first current level to be the regulated current level.

17. The LED driver of claim 15, further comprising:

a sense connection of the drive interface that is separate from a power connection of the drive interface; and an analog-to-digital converter coupled to the processor and configured to measure a voltage at the sense connection of the drive interface;

the one or more instructions, in response to being executed by the processor, further cause the LED driver to:

provide the electrical power to the power connection of the drive interface at a regulated current level;

measure an unregulated voltage level at the sense connection of the drive interface using the ADC while providing the electrical power to the power connection of the drive interface at the regulated current level;

increase the regulated current level until the unregulated voltage level is equal to the first voltage level; and determine the first current level to be the regulated current level.

18. The LED driver of claim 15, the one or more instructions, in response to being executed by the processor, further cause the LED driver to:

receive drive information from the LED load through the drive interface;

determine whether the LED load has a constant voltage load characteristic or a constant current load characteristic based on the drive information; and provide the electrical power to the LED load through the power connection of the drive interface at a third current level that is based on the drive information in response to said determining that the LED load has the constant current load characteristic;

wherein said providing the electrical power to the power connection of the drive interface at the first voltage level is done in response to said determining that the LED load has the constant voltage load characteristic, and the first voltage level is set based on the drive information.

19. An article of manufacture comprising a non-transitory storage medium having instructions stored thereon that in response to being executed by the processor cause an LED driver to perform a method comprising:

receiving drive information from an LED load;

determining whether the LED load has a constant voltage characteristic or a constant current characteristic based on the drive information;

providing electrical power to the LED load at a first voltage level that is based on the drive information in response to said determining that the LED load has the constant voltage characteristic; and providing the electrical power to the LED load at a second current level that is based on the drive information in response to said determining that the LED load has the constant current characteristic.

20. The article of manufacture as claimed in claim 19, the method further comprising:

determining a first current level consumed by the LED load while the first voltage level is applied to the LED load in response to said determining that the LED load has the constant voltage characteristic;

receiving brightness control information for the LED load;

calculating a third current level based on the brightness control information and either the first current level or the second current level; and providing the electrical power to the LED load regulated to the third current level regardless of whether the LED load has the constant voltage characteristic or the constant current characteristic.

* * * * *